US009101959B2

(12) United States Patent
Burton

(10) Patent No.: US 9,101,959 B2
(45) Date of Patent: Aug. 11, 2015

(54) VIBRATORY DEVICE WITH REPOSITIONABLE WEIGHTS AND METHOD OF EXTENDING THE USEFUL LIFE OF VIBRATORY DEVICES

(75) Inventor: Grant S. Burton, Dunlap, IL (US)

(73) Assignee: Martin Engineering Company, Neponset, IL (US)

( * ) Notice: Subject to any disclaimer, the term of this patent is extended or adjusted under 35 U.S.C. 154(b) by 450 days.

(21) Appl. No.: 13/458,582

(22) Filed: Apr. 27, 2012

(65) Prior Publication Data

US 2013/0283941 A1 Oct. 31, 2013

(51) Int. Cl.
*B06B 1/16* (2006.01)

(52) U.S. Cl.
CPC ..... *B06B 1/161* (2013.01); *Y10T 74/18552* (2015.01)

(58) Field of Classification Search
CPC ..... B06B 1/166; B06B 1/161
USPC ..... 74/61, 87
See application file for complete search history.

(56) References Cited

U.S. PATENT DOCUMENTS 3,456,885 A * 7/1969 Bodine ..... 241/1
3,757,148 A 9/1973 Philibert
3,771,374 A 11/1973 Choules
3,772,923 A 11/1973 Burt
4,040,303 A 8/1977 Makino
4,590,814 A 5/1986 Wadensten
5,177,386 A 1/1993 Shimada
5,181,432 A * 1/1993 Allen ..... 74/395
5,666,852 A 9/1997 Musschoot
7,589,446 B2 9/2009 Suzuki et al.
7,705,500 B2 4/2010 Mills et al.
7,709,983 B2 5/2010 Umehara et al.
2003/0020345 A1 1/2003 Mooney

FOREIGN PATENT DOCUMENTS

GB 1583788 A 2/1981

* cited by examiner

*Primary Examiner* — William C Joyce
(74) *Attorney, Agent, or Firm* — Thompson Coburn LLP; Clyde L. Smith

(57) ABSTRACT

A method comprises accessing a vibratory device having a rotor and first and second eccentric weights. The first weight is initially attached to the rotor's shaft in a manner such that its center of the mass is offset from the shaft in a first radial direction. The second weight is initially attached to the shaft in a manner such that its center of the mass is also offset in the first radial direction. The method further comprises reorienting the first and second weights relative to the shaft in a manner such that their centers of the mass are offset in a second radial direction. By performing these steps, the location of greatest bearing surface wear rate on the shaft is circumferentially relocated about the shaft. As such, the service life of an eccentric weight vibratory device is thereby extended.

4 Claims, 4 Drawing Sheets

VIBRATORY DEVICE WITH REPOSITIONABLE WEIGHTS AND METHOD OF EXTENDING THE USEFUL LIFE OF VIBRATORY DEVICES

CROSS-REFERENCE TO RELATED APPLICATIONS

Not Applicable

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to vibratory devices of the type used in the bulk material handling industry. More particularly, this invention pertains to a rotary vibratory device having repositionable eccentric weights and to methods for extending the useful life of such rotary vibratory devices.

2. General Background

Vibratory devices are used throughout the bulk material handling industry for various purposes. Vibratory devices are often attached to bulk material transfer chutes and bulk material storage hoppers to prevent bulk material from clinging to the walls of such chutes and hoppers. Vibratory devices are also utilized on sifting screens to prevent larger material from clogging the sifting screens and to speed the flow of material passing through the screens.

A common type of vibratory device is the rotary vibratory motor, wherein eccentric weights are rotationally driven by, and rotate about, a shaft and thereby create a oscillating forces. Other types of vibratory devices include, but are not limited to, acoustical vibration devices, air driven rotary vibrators, and linear vibrators. The present invention pertains specifically to the rotary vibratory device wherein on or more eccentric weight is rotationally driven by a shaft (hereafter referred to simple as a rotary vibratory device).

In rotatory vibratory devices, the forces generating in by the rotating eccentric weights are transmitted to the motor housing via the bearings that support the rotor shaft. In view of the eccentricity of the weights, the bearing forces acting on the rotary shaft peak on the side of the bearing shaft that is closest to the center of mass of the eccentric weights, while the opposite side of the rotor shaft sees little, if any, bearing load. As a result, the portion of the bearing surface of the shaft closest to the center of mass of the eccentric weights wears at the greatest rate.

SUMMARY OF THE INVENTION

The inventors of the present invention have appreciated that the useful life of rotary vibratory devices can be extended by periodically altering the location of greatest bearing surface wear rate circumferentially about the shaft. The inventors have also developed rotary vibratory devices that are configured and adapted to allow for periodically altering the location of greatest bearing surface wear rate with minimal effort.

In one aspect of the invention, a method of extending the service life of an eccentric weight vibratory device comprises accessing a vibratory device. The vibratory device comprises a rotor and first and second eccentric weights. The rotor has a central shaft about which the rotor is configured to rotate. The shaft has opposite first and second end portions. The first eccentric weight is initially attached to the first end portion of the shaft in a manner such that the center of the mass of the first eccentric weight is offset in a first radial direction from the shaft. The second eccentric weight is initially attached to the second end portion of the shaft in a manner such that the center of the mass of the second eccentric weight is also offset in the first radial direction from the shaft of the rotor. The method also comprises reorienting the first eccentric weight relative to the shaft in a manner such that the center of the mass of the first eccentric weight is offset in a second radial direction from the shaft, and reorienting the second eccentric weight relative to the shaft in a manner such that the center of the mass of the second eccentric weight is offset in the second radial direction from the shaft. By performing these steps, the location of greatest bearing surface wear rate on the shaft is circumferentially relocated about the shaft. As such, the service life of an eccentric weight vibratory device is thereby extended.

In another aspect of the invention, a vibratory device comprises a rotor having a shaft. The shaft has a shaft axis about which the rotor is configured to rotate. The shaft also comprises a first end portion having a plurality of keyways that are spaced circumferentially about the shaft axis relative to each other. An eccentric weight is mounted on the first end portion of the shaft. The eccentric weight has a center of mass that is offset from the shaft axis and has an opening through which the first end portion of the shaft extends. The opening comprises a keyway. The vibratory device also comprises a key. The key is positioned between one of the keyways of the shaft and the keyway of the eccentric weight in a manner such that the first eccentric weight is not able to rotate relative to the shaft about the shaft axis.

Further features and advantages of the present invention, as well as the operation of the invention, are described in detail below with reference to the accompanying drawings.

Figure 1:
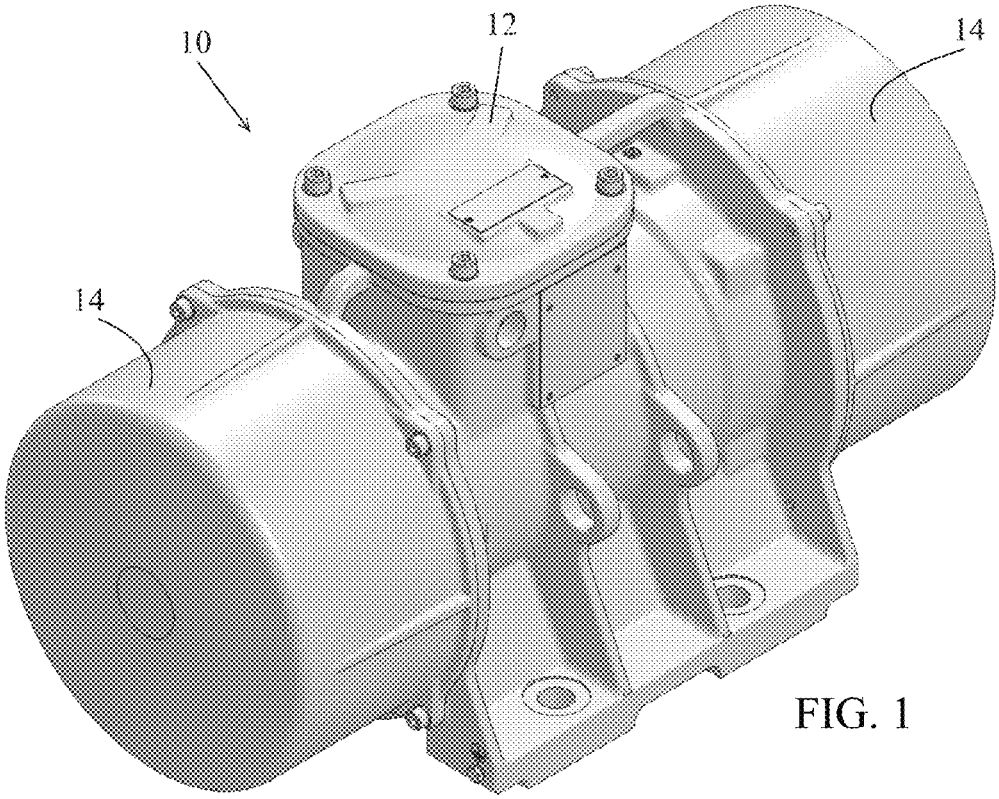
FIG. 1 depicts a perspective view of a rotary vibratory device.

Reference numerals in the written specification and in the drawing figures indicate corresponding items.

DETAILED DESCRIPTION

Figure 2:
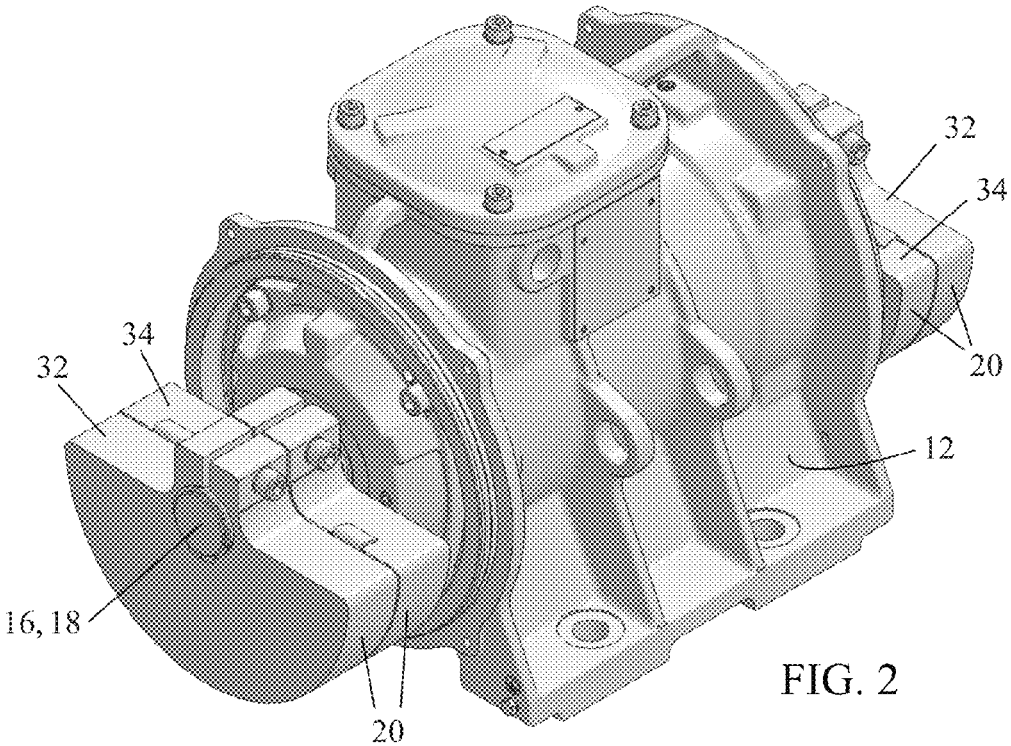
FIG. 2 depicts the vibratory device of FIG. 1, with its end caps removed for servicing.
Figure 3:
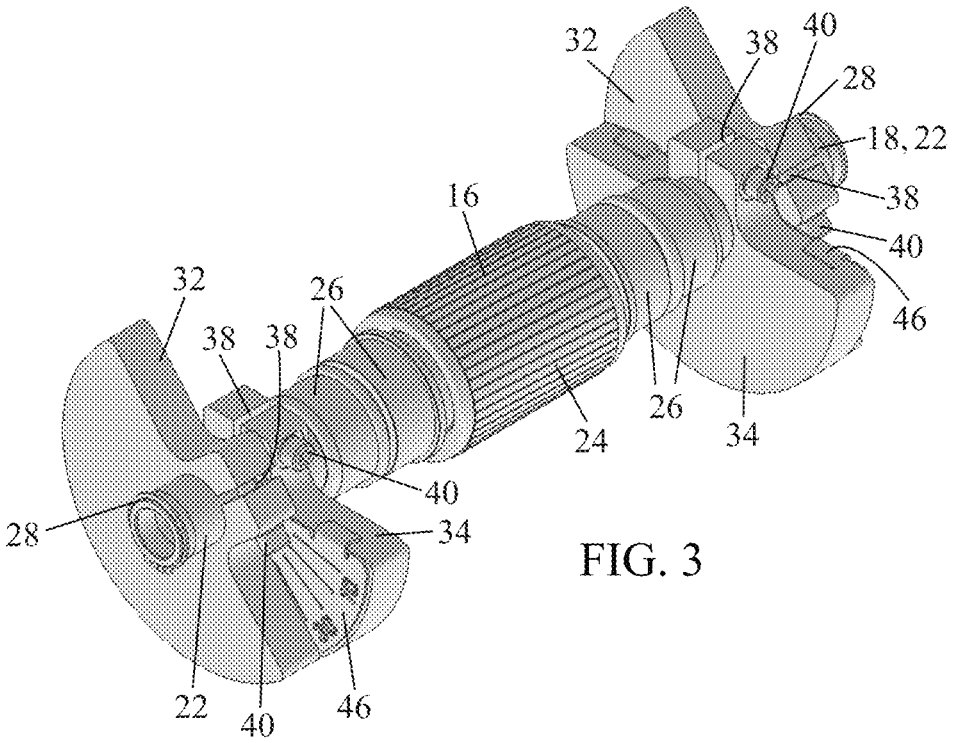
FIG. 3 depicts an initial configuration of a plurality of eccentric weights mounted on the shaft of the rotor of the vibratory device shown in FIGS. 1 and 2.
Figure 4:
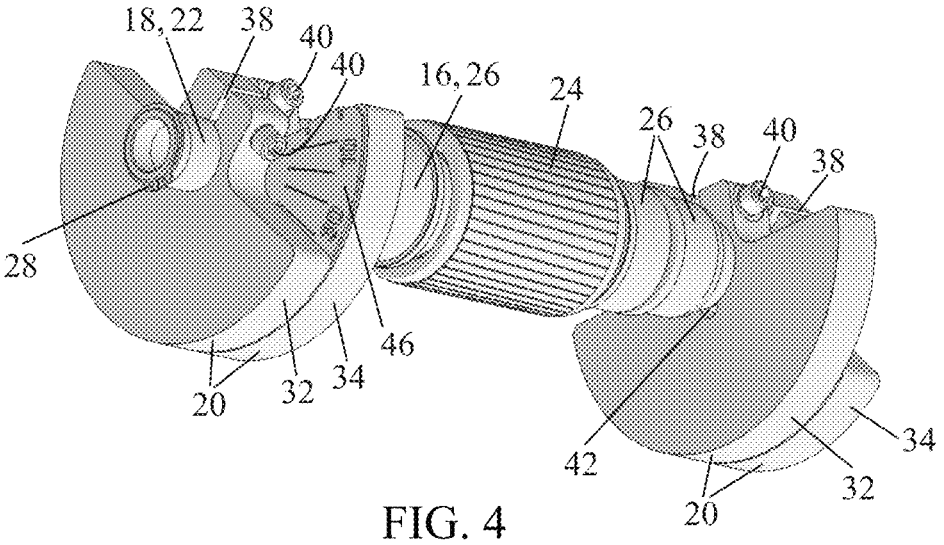
FIG. 4 depicts another view of the rotor and weights in the initial configuration.

A preferred embodiment of a rotary vibratory device in accordance with the present invention is shown in FIGS. 1 and 2. The vibratory device 10 comprises an outer housing 12 having removable end caps 14. Internally, the vibratory device 10 comprises a rotor 16 having a shaft 18. A plurality of eccentric weights 20 are mounted on the shaft 18 of the rotor 16 for rotation therewith.

Although some rotary vibratory devices may include only one eccentric weight or have eccentric weights only on one end of rotor shaft, the preferred embodiment of a rotary vibratory device 10 in accordance with the present invention comprises at least one eccentric weight 20 at each of the opposite end portions 22 of the rotor's shaft 18. Preferably the weights 20 are balanced such that the forces acting on each end portion of the shaft 18 equal each other and act in the same direction.

As is shown most clearly in FIGS. 3-7, the rotor 16 comprises an armature 24 that is centrally positioned on the shaft 18. The rotor 16 also comprises a plurality of bearings 26 that attach the rotor to the housing 12 for rotation (and transmit the vibrational forces to the housing). Each of the opposite end portions 22 of the shaft 18 comprises an anular groove that is configured to receive a removable retaining ring 28. Additionally, each of the opposite end portions 22 of the shaft 18 comprises a plurality of keyways 30 that are circumferentially spaced from each other about the shaft. Preferably, each of the opposite end portions 22 of the shaft 18 comprises two or more axially oriented keyways 30 that are evenly spaced apart from each other about the shaft. The keyways 30 are preferably simple slots milled into the shaft 18. The eccentric weights 20 attached to the end portions 22 of the shaft include outboard eccentric weights 32 and inboard eccentric weights 34. Each end portion 22 of the rotor shaft 18 has one outboard weight 32 and one inboard eccentric weight 34 attached thereto. Each of the eccentric weights 20 comprises a mounting hole 36 that is offset from the center of mass of the eccentric weight and that is dimensioned to fit snugly around the shaft 18. Each of the eccentric weights 20 also comprises slit 38 that extends into the mounting hole 36 and that allows the eccentric weight to be tightly clamped to the shaft via a bolt 40. Moreover, the mounting hole 36 of at least each of the inboard eccentric weights 34 also comprises an axially extending keyway 42 that is preferably milled into the weight. The rotor 16 further comprises a key 44 and preferably a pair of adjustment guides 46.

The eccentric weights 20 of the vibratory device 10 are initially axially and rotationally locked to the shaft 18 of the rotor 16 in an initial position. The keyway 42 of each of the inboard eccentric weights 34 is aligned with one of the keyways 30 of the shaft 18 and one of the keys 44 is positioned between said keyways in a manner rotationally locking the weight to the shaft. Given that each end portion 22 of the shaft 18 preferable has at least two keyways 30, each inboard eccentric weight 34 is positionable in alternative positions relative to the shaft. As mentioned above, a bolt 40 also clamps each of the eccentric weights to the shaft 18 in a manner such that the weights cannot rotate or axially slide relative to the shaft. Thus, the keys 44 and keyways 30, 42 serve primarily to index the inboard eccentric weights 34 and to ensure that they are aligned with each other. The outboard eccentric weights 32 may or may not be aligned with the inboard eccentric weights 34. In other words, the center of mass of the outboard eccentric weights 32 may be offset from the axis of rotation of the shaft 18 in a different direction than is the center of mass of the inboard eccentric weights 34. Unlike the inboard eccentric weights 34, the orientation angle of the outboard eccentric weights 32 relative to the shaft is infinitely variable since the outboard eccentric weights and the shaft are not keyed to each other. It should be appreciated that the rotational position of the outboard eccentric weights 32 relative to the inboard eccentric weights 34 determines the combined center of mass of the weights and the more out of alignment the inboard and outboard weights are, the closer the combined center of mass is to the axis about which the shaft 18 rotates. The radial distance between the combined center of mass of the eccentric weights 20 and the shaft axis determines the amplitude of the vibrations created by the vibratory device 10 at any given revolutions per minute.

Figure 5:
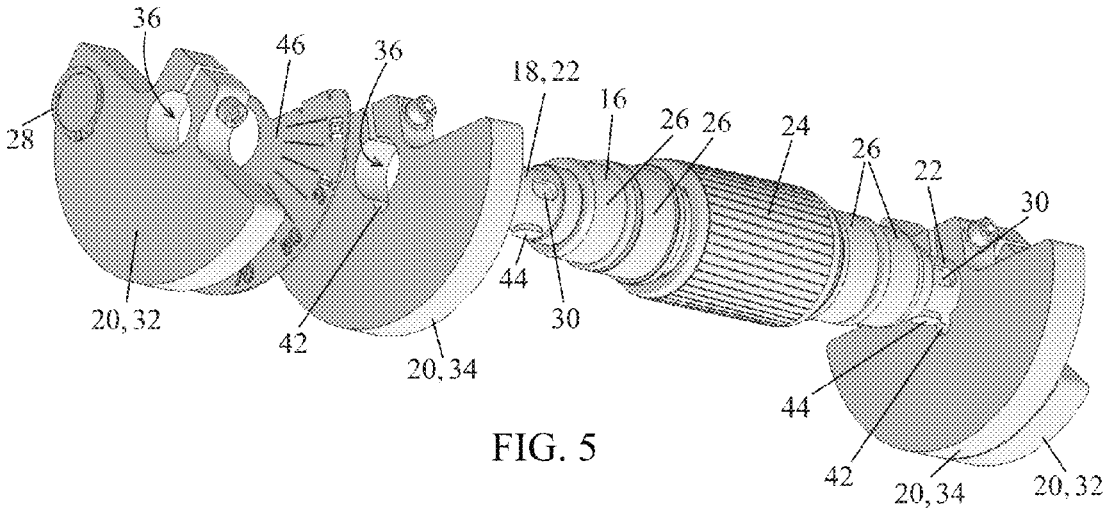
FIG. 5 depicts the rotor and weights from the same viewing angle as shown in FIG. 4, but is shown with the weights disengaged from the shaft keys.
Figure 6:
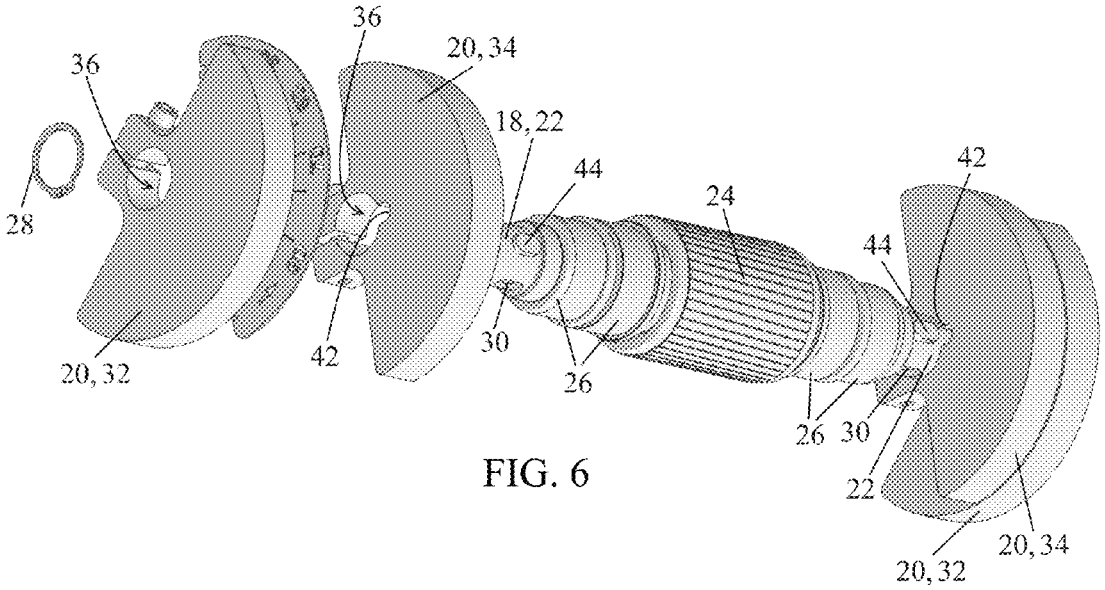
FIG. 6 depicts the rotor and weights from the same viewing angle as shown in FIGS. 4 and 5, and shows the weights and shaft keys repositioned about the rotor shaft ninety degrees.
Figure 7:
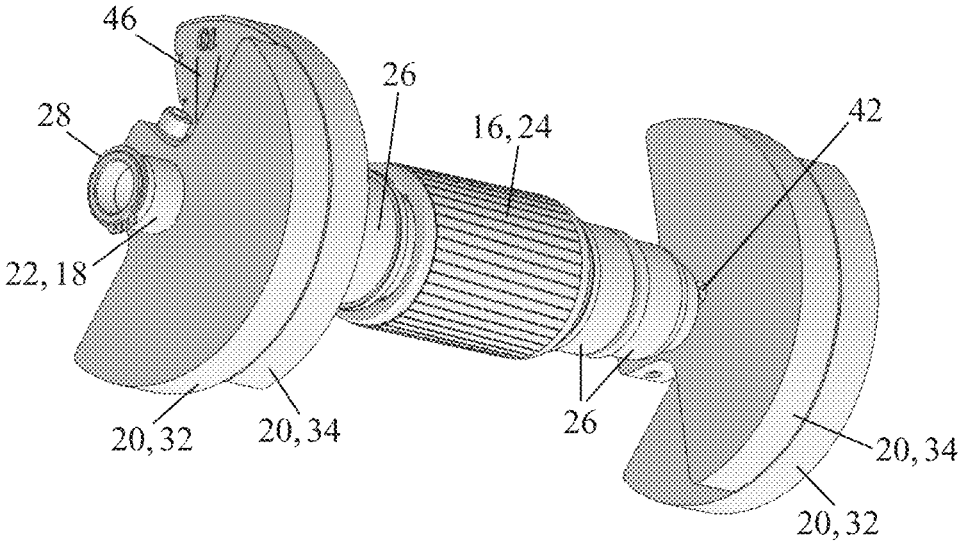
FIG. 7 depicts the rotor and weights from the same viewing angle as shown in FIGS. 4-6, and shows the weights reengaged with the shaft keys after having been rotationally repositioned.

It should be appreciated that as the rotary vibratory device 10 operates, the greatest bearing load on the bearing surfaces of the shaft 18 (which engage the bearings 26 of the rotor 16) occur on the side of the shaft facing the center of mass of the eccentric weights 20. As such, those portions of the shaft 18 wear faster than the other portions of the bearing surfaces of the shaft. Eventually the wear exceeds an acceptable amount. At that point or time, the vibratory device 10 can be serviced to change the location of the greatest bearing load on the bearing surfaces of the shaft 18. To do this, a technician removes the end caps 14 of the vibratory device's 10 housing 12 to expose the eccentric weights 20 (see FIG. 2). The technician then loosens the bolts 40 that secure the eccentric weights 20 to the end portions 22 of the shaft 18 of the rotor 20. Thereafter the technician axially slides the eccentric weights 20 away from armature 24 of the rotor 16 to disengage the keyways 42 of the inboard eccentric weights 34 from the shaft keys 44, as is shown in FIG. 5 (note: although FIGS. 3-7 show the rotor removed from the housing 12, it is shown that way for clarity and the rotor remains in the housing during servicing). Preferably the end portions 22 of the shaft 18 are long enough such that the weights 20 can be axially slide on the shaft enough to disengage the keyways 42 of the inboard eccentric weights 34 from the shaft keys 44 without removing the weights from the shaft (as is shown on the right side of the rotor 16 in FIG. 5). To this end, the retaining rings 28 serve as end stops for preventing the eccentric weights 20 from sliding off of the rotor's 16 shaft 18. With the shaft keys 44 exposed, the technician can remove the keys and place them in another set of the plurality of keyways 30 of the shaft, and then rotate the inboard eccentric weights 34 relative to the shaft 18 until the keyways 42 of the inboard eccentric weights are once again aligned with the shaft keys (as shown in FIG. 6). Following that, the eccentric weights 20 are pushed axially inboard such that the shaft keys 44 lie between the keyways of the shaft 30 and the keyways 42 of the inboard eccentric weights 34 (as shown in FIG. 7). The outboard eccentric weights 32 are also rotated into their proper orientation relative to the inboard weights 34, using the adjustment guides (which include graduated markings showing the relative angles between the inboard and outboard weights).

Following the servicing of the vibratory device 10, the device will operate in the same manner that it did before servicing, except that the location of the greatest bearing load on the bearing surfaces of the shaft 18 will be different from before. Although the shaft 18 of the vibratory device 10 is shown in the figures having four keyways 30 at each of its opposite end portions 22, preferably it only has two keyways at each end. Having only two keyways 30 at each end of the shaft 18 ensures that there won't be any overlap in the wear area on the inner bearing race of the shaft from one position to the next. Thus, the vibratory device 10 can continue to operate without risking failure. Moreover, if more than two keyways 30 are provided at each end portion 22 of the shaft 18, the servicing procedure can be performed additional times (each time placing the key 44 in a yet to be used keyway 30 of the shaft 18). Thus, using the present invention, the useful life of the vibratory device 10 can be extended by at least twice that of standard vibratory device. It should also be appreciated that the key 44 and keyways 30, 42 of the vibratory device 10 are configured and adapted to assist a technician in rotationally indexing the eccentric weights 20 and are not the primary means for torsionally locking the eccentric weights to the shaft.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such and order is inherent.

What is claimed is:

1. A vibratory device comprising:

a rotor having a shaft, the shaft having a shaft axis about which the rotor is configured to rotate, the shaft comprising a first end portion having a plurality of keyways that are spaced circumferentially about the shaft axis relative to each other, the first end portion also comprising an annular groove, the shaft comprising a second end portion having a plurality of keyways that are spaced circumferentially about the shaft axis relative to each other, the second end portion comprising an annular groove;

a first eccentric weight mounted on the first end portion of the shaft, the first eccentric weight having a center of mass that is offset from the shaft axis, the first eccentric weight having an opening through which the first end portion of the shaft extends, the opening comprising a keyway;

a first key, the first key being positioned between one of the keyways of the shaft and the keyway of the first eccentric weight in a manner such that the first eccentric weight is not able to rotate relative to the shaft about the shaft axis;

a first retaining ring, the first retaining ring being received in the annular groove of the first end portion of the shaft and being spaced axially outboard from the first eccentric weight in a manner such that the first eccentric weight can be axially slid along the shaft to an extent such that the first eccentric weight can be disengaged from the first key, the first retaining ring serving as an end stop for preventing the first eccentric weight from being slid off of the first end of the shaft;

a second eccentric weight mounted on the second end portion of the shaft, the second eccentric weight having a center of mass that is offset from the shaft axis and an opening through which the second end portion of the shaft extends, the opening of the second eccentric weight comprising a keyway;

a second key that is positioned between one of the keyways of the second end portion of the shaft and the keyway of the second eccentric weight in a manner such that the second eccentric weight is not able to rotate relative to the shaft about the shaft axis;

a second retaining ring, the second retaining ring being received in the annular groove of the second end portion of the shaft and is spaced axially outboard from the second eccentric weight in a manner such that the second eccentric weight can be axially slid along the shaft to an extent such that the second eccentric weight can be disengaged from the second key, the second retaining ring serving as an end stop for preventing the second eccentric weight from being slid off of the second end of the shaft.

2. A vibratory device in accordance with claim 1 wherein the center of mass of the first eccentric weight is circumferentially aligned with the center of mass of the second eccentric weight relative to the shaft axis.

3. A vibratory device in accordance with claim 2 wherein the second key is circumferentially aligned with the first key relative to the shaft axis.

4. A vibratory device in accordance with claim 1 wherein the vibratory device comprises a third eccentric weight, the center of mass of the first eccentric is offset from the shaft axis in a first direction, the third eccentric weight is mounted on the first end portion of the shaft and has a center of mass that is offset from the shaft axis in a second direction, the first and second directions defining an included angle therebetween, the third eccentric weight being rotationally repositionable about the shaft axis relative to the first eccentric weight and rotationally lockable to the shaft in a manner such that the included angle is infinitely variable, the first retaining ring is spaced axially outboard from the third eccentric weight and serves as end stop for preventing the third eccentric weight from being slid off of the first end of the shaft.

* * * * *